US005823021A

United States Patent [19]

Chang

[11] Patent Number: 5,823,021

[45] Date of Patent: Oct. 20, 1998

[54] STRUCTURE OF PADLOCK

[76] Inventor: Charlie Chang, 7F-2, No. 95-8 Chang Ping Road, Sec. 1, Taichung, Taiwan

[21] Appl. No.: 575,674

[22] Filed: Dec. 18, 1995

[51] Int. Cl.[6] ..... E05B 67/22

[52] U.S. Cl. ..... 70/38 A; 70/39; 70/233

[58] Field of Search ..... 70/38 A, 39, 233, 70/67, 69–71, 113

[56] References Cited

U.S. PATENT DOCUMENTS

| | | | |
|---|---|---|---|
| 2,691,288 | 10/1954 | Childs | 70/38 A |
| 3,400,562 | 9/1968 | Bloss | 70/70 |
| 3,979,931 | 9/1976 | Man | 70/38 A |
| 4,290,280 | 9/1981 | Yun | 70/38 A |
| 4,881,387 | 11/1989 | Kortenbrede | 70/39 |
| 5,101,646 | 4/1992 | Goldman et al. | 70/38 A |
| 5,189,893 | 3/1993 | Kortenbrede | 70/38 A |
| 5,331,830 | 7/1994 | Su | 70/38 A |
| 5,398,529 | 3/1995 | Goldman et al. | 70/38 A |
| 5,417,092 | 5/1995 | Iu | 70/38 A |
| 5,488,845 | 2/1996 | Hsieh | 70/233 |

FOREIGN PATENT DOCUMENTS

| | | | |
|---|---|---|---|
| 2500521 | 8/1982 | France | 70/113 |
| 2054021 | 2/1981 | United Kingdom | 70/38 A |
| 2141170 | 12/1984 | United Kingdom | 70/38 A |

*Primary Examiner*—Suzanne L. Dino

[57] ABSTRACT

A structure of padlock is provided. The padlock comprises a hollow cylinder body, a U-shaped shackle arms and a locking mechanism which is composed of a pair of sliding members symmetrically arranged in the cylinder body and movably connected to a disk member via a pair of lever members and urged outwardly by a pair of compression springs. The sliding members normally position at a pair of locking holes for facilitating an automatic locking up the shackle arms into the cylinder body, and the shackle arms are unlocked by rotating the disk member clockwise with a key so as to actuate the sliding members moving centralizedly. The symmetrical arrangement of the components in the locking mechanism provides the stability as well as the durability of a padlock.

1 Claim, 5 Drawing Sheets

STRUCTURE OF PADLOCK

BACKGROUND OF THE INVENTION

The present invention relates to locks, more particularly to a U-shaped padlock which provides a simplified and durable structure and a readily locking mechanism to which the arms of a shackle are automatically locked up when engaged therewith.

Padlock varies in the shapes and the mechanism. A U-shaped padlock which suits to lock bicycle, motorcycle and the like generally has a pair of locking holes through an elongate member for inserting the arms of a U-shaped shackle to be locked up therein. Currently, in most case, the core of the U-shaped padlock is secured to one end of the elongate member and operated by swinging a key to indirectly actuate a catch plate which slides about the elongate member to lock or unlock the arms of the shackle, and the arms of the shackle are retained by the annular locking notches of the arms.

This arrangement exposes numerous structural disadvantages such that the core is marring under frequent tensile force, the parts in the locking mechanism are tiny, weak and undurable, and in normal condition, the padlock cannot be locked up without operating by a key.

SUMMARY OF THE PRESENT INVENTION

The main object of the present invention is to provide a structure of padlock which is automatically lockable without operating by a key.

Another object of the present invention is to provide a structure of padlock in which the core member of the padlock is secured to the central portion of an elongate body perpendicular to the locking holes so as to facilitate a symmetrical arrangement of the locking mechanism in the elongate body and maintain the stability of the padlock.

Still another object of the present invention is to provide a structure of padlock in which the ends of the elongate body are fixedly closed up and disengaged with the locking mechanism so as to ensure it's durability.

Accordingly, the structure of padlock of the present invention comprises generally a hollow cylinder body having a pair of locking holes through the body, a protrudent central hole perpendicular to the locking holes, a pair of sliding members pivotally connected to one end of a pair of lever members which have their other ends movably connected with a disk member, a core secured in the protrudent central hole and coupled with the disk member so as to synchronously swing with the disk member, a pair of compression springs biased between the sliding members and the core for urging the sliding members in place of a locking position, and a U-shaped shackle member having a pair of locking arms for inserting into the locking holes of the cylinder body to force the sliding members to move about the cylinder body therein in order to achieve an automatic locking up.

The present invention will become more fully understood by reference to the following detailed description thereof when read in conjunction with the attached drawings.

DETAILED DESCRIPTION OF THE PREFERRED EMBODIMENT

Figure 1:
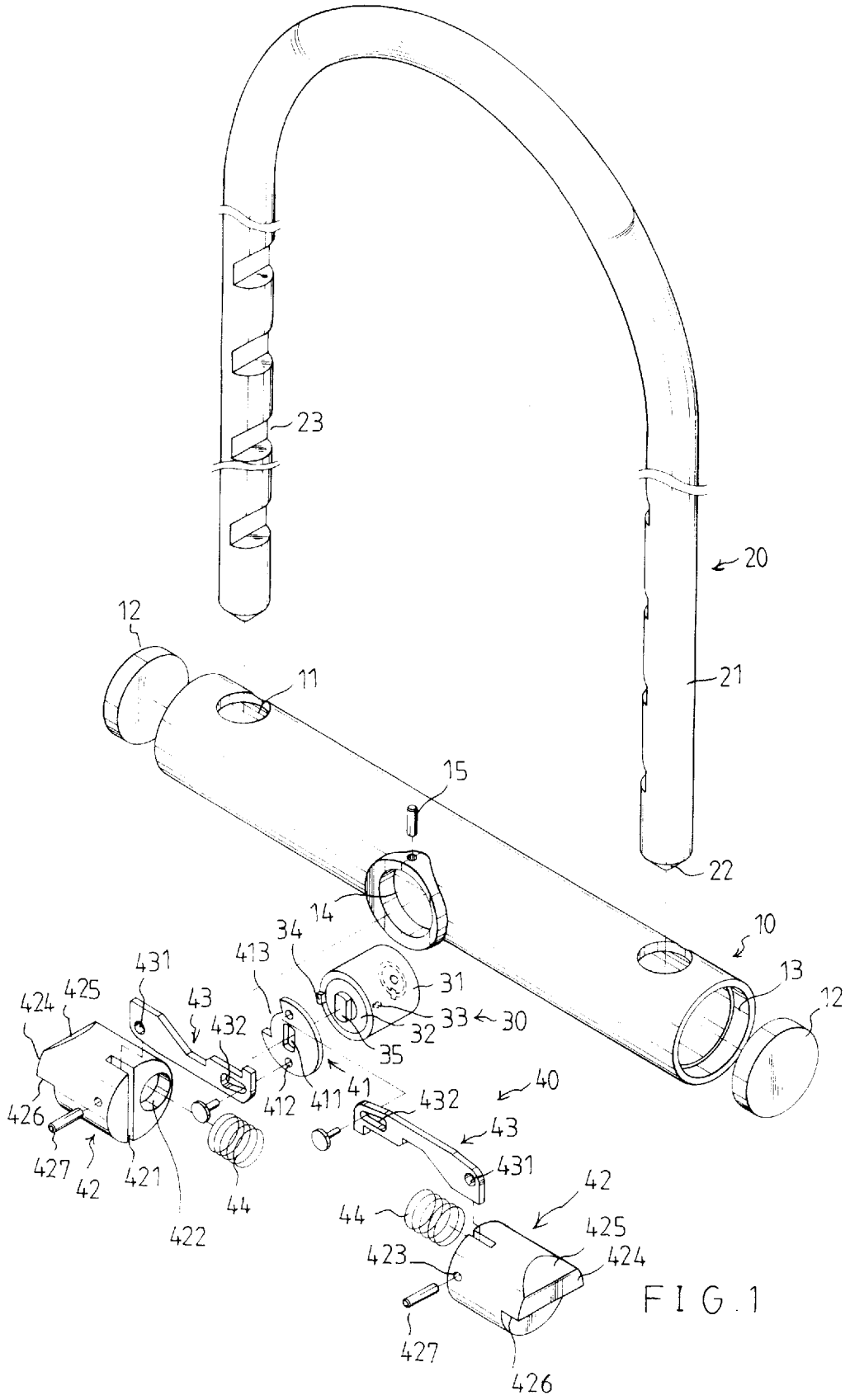
FIG. 1 is an exploded perspective view showing the preferred embodiment of the present invention.
Figures 2, 3:
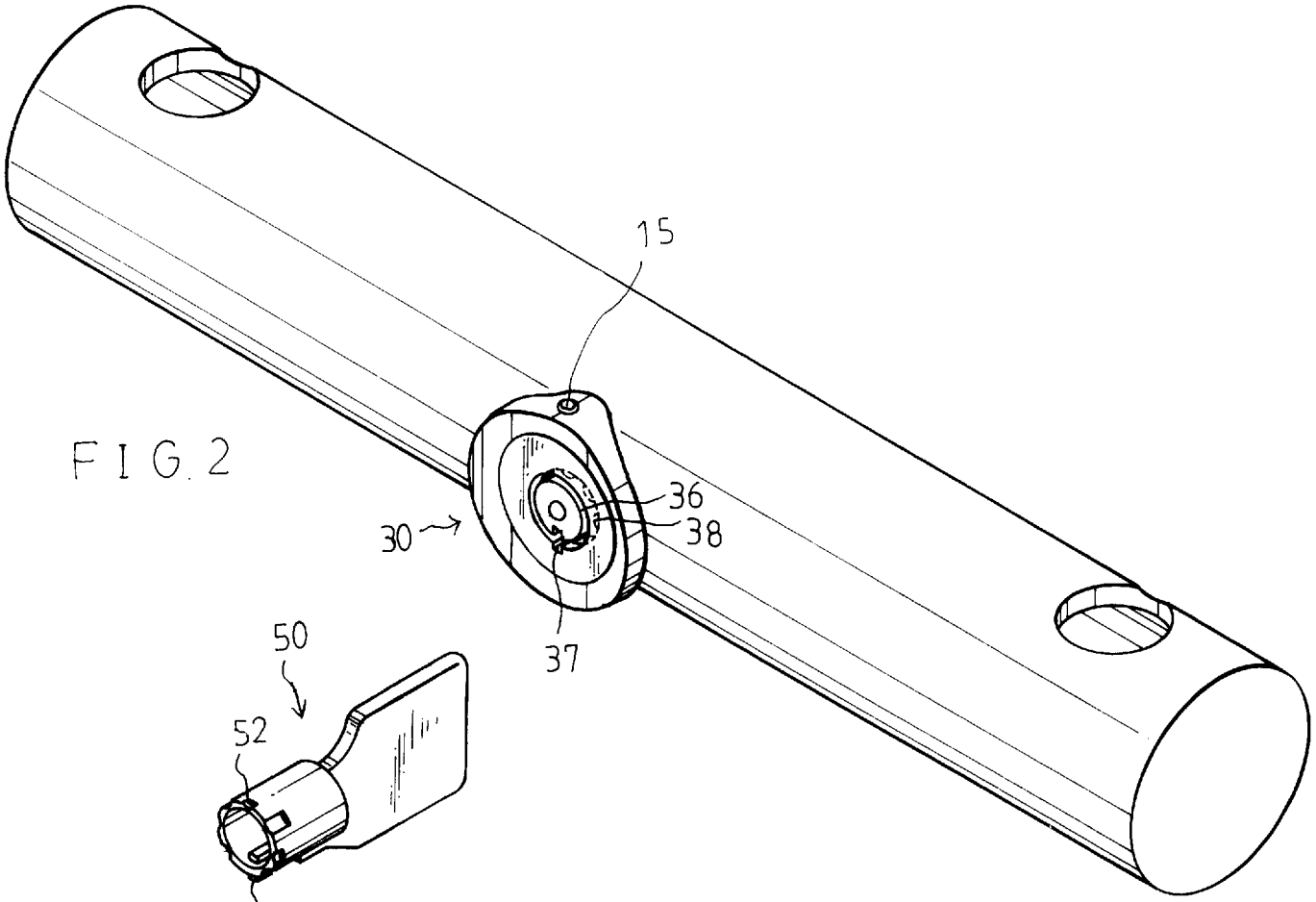
FIG. 2 is a perspective view showing a core secured to a hollow cylinder body of the padlock of the present invention.
FIG. 3 is a perspective view showing a key made in accommodation with the core according to the present invention.

With reference to FIG. 1 and 2, the structure of the padlock comprises generally a hollow cylinder body 10, a U-shaped shackle member 20, a core 30 and a locking mechanism 40.

The hollow cylinder body 10 has a pair of locking holes 11 through the body and in the proximity thereof for inserting the U-shaped shackle member 20 therethrough, a pair of circular caps 12 fixedly closed up the ends 13 of the cylinder body 10 and a protrudent hole 14 positioned at the center of the cylinder body 10 perpendicular to the locking holes 11.

The U-shaped shackle member 20 has a pair of locking arms 21 which have their tapered ends 22 and a plurality of beveled notches 23 formed spaced apart on their inward surfaces opposite to each other.

The core 30 has a cylinder body 31, a central axis 32, a pair of recesses 33 on the opposing lateral peripheries, a knot means 34 at a circumference of one end thereof and a rectangular projection 35 on one end of the axis 32 adjacent the knot means 34. The other end of the core 30 as shown in FIG. 2 has a circular slot 36, an elongate slot 37 extended along a radial line and across the circular slot 36 and a plurality of ogives 38 formed spaced apart in the circular slot 26 which are arranged to register with the corresponding rectangular projection and the recesses 52 of a key 50. This arrangement is intended to identify a key with the core 30 for anti-burglary purpose. The identification arrangement between the key and the core can be substantially varied.

The locking mechanism 40 comprises a disk member 41, a pair of sliding members 42, a pair of lever members 43 and a pair of compression springs 44.

The disk member 41 has a rectangular slot 411 at the center fitted to the rectangular projection 35 of the core 30, a pair of rivets 412 symmetrically positioned adjacent the ends of the slot 411 and an indentation 413 on a circumference and adjacent one of the rivets 412.

The sliding members 42 each has a cylinder body diametrically equal to the inner diameter of the hollow cylinder body 10 so as to slide about therein, a vertical slot 421 abutting a circular cavity 422 formed on the inward end thereof, an eye 423 transversely formed in a lateral periphery in communication with the slot 421, and a latch means 424 on the other end which is composed of a beveled surface on the top and a right angular surface on the bottom.

The pair of lever members 43 each has an eye 431 on outward end made in registry with the corresponding eye 423 on the sliding member 42 and an elongate slot 432 on the other end thereof.

Figure 4:
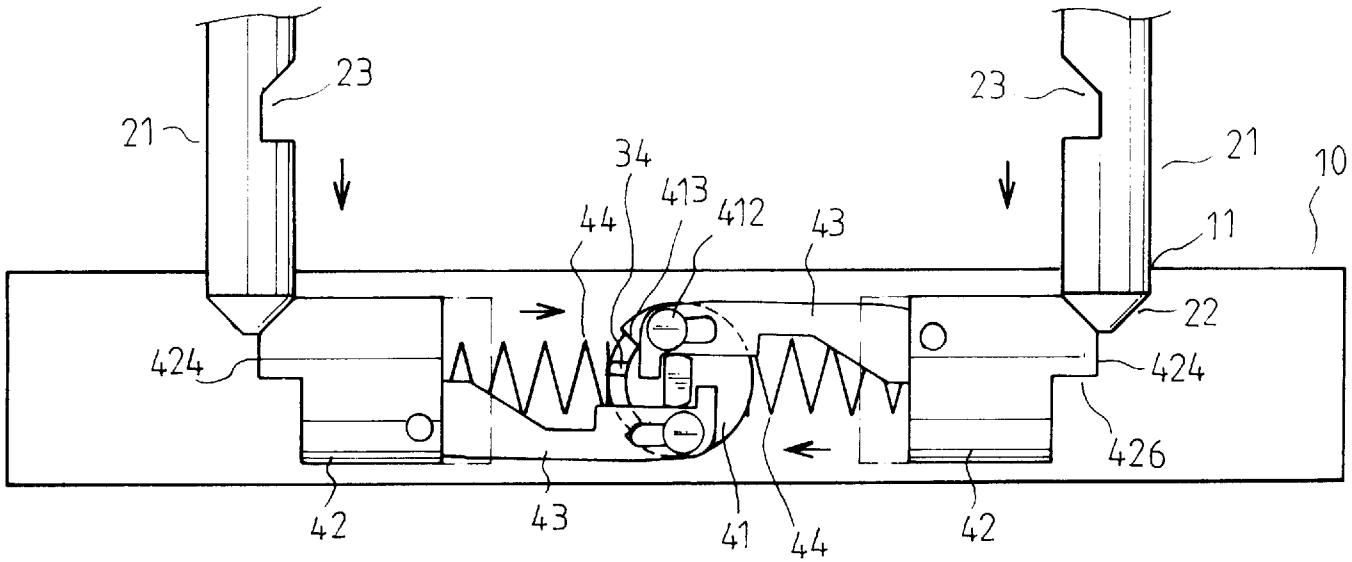
FIG. 4 is a sectional view showing the sliding members being urged in place of a normal position.

Referring to FIGS. 1, 2 and 4, when assembly, one end of the compression springs 44 anchor in the cavity 422 of the respective sliding members 42, the other end thereof rest in the recesses 33 of the core 30. The outward end of the lever members 43 slide in the vertical slot 421 of the respective sliding members 42 and pivotally secured by a retaining pin 427 and the elongate slot 432 on the inward ends thereof movably secured by the pair of the rivets 412 on the disk member 41. Note that the lever members 43 are invertedly arranged within the locking mechanism 40 so as to fascilitate a leverage movement. When the locking mechanism 40 slides into the hollow cylinder body 10, the core 30 inserts into the protrudent hole 14 of the body 10 with the rectangular projection 35 thereof inserted into and engaged with the rectangular slot 411 of the disk member 41 and the knot means 34 thereof stopped against the lower end of the indentation 413 and then secured by a pair of rivets 15. The end portions 13 of the hollow cylinder body are fixedly closed by the pair of caps 12 respectively.

Figure 5:
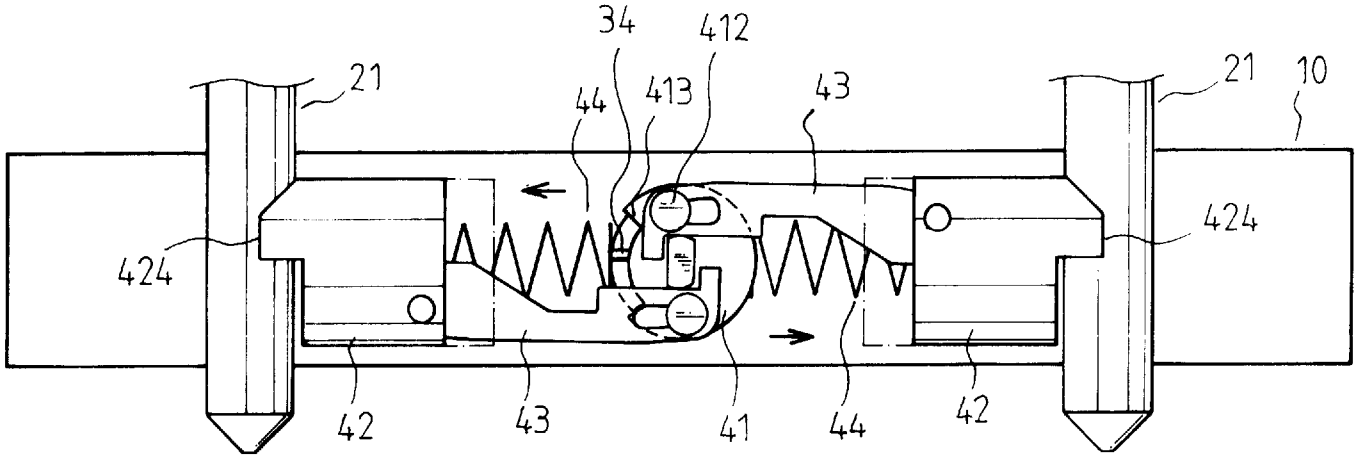
FIG. 5 is a sectional view showing the locking arms being automatically retained by the sliding members.
Figure 6:
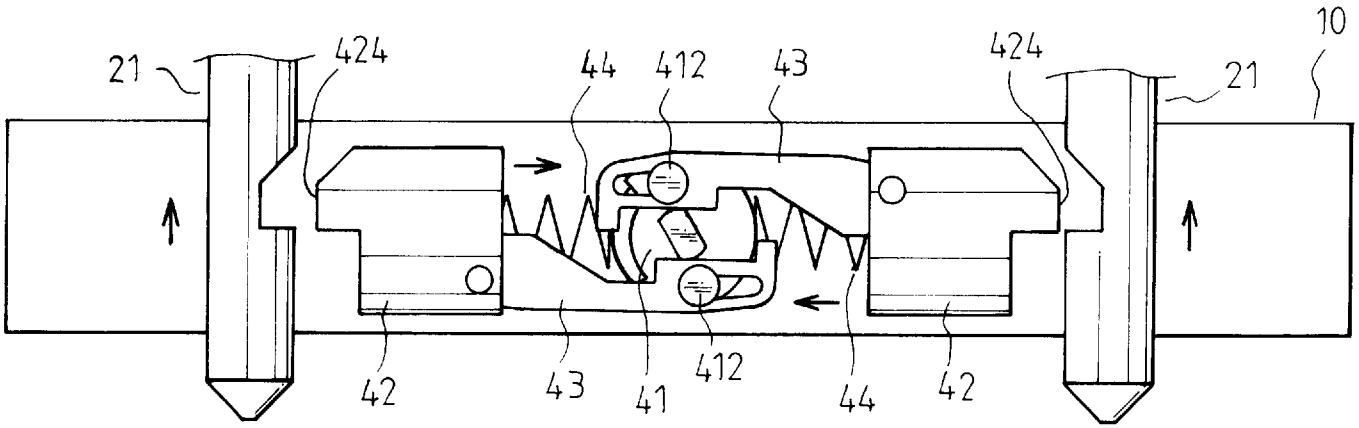
FIG. 6 is a sectional view showing the locking arms being released as the disk member is swung clockwise by a key.

Referring to FIGS. 4 to 6, the sectional views illustrate that the sliding members 42 are urged by the compression springs 44 apart from the disk member 41 and retained centralizedly by the pair of the lever members 43 so that they are normally positioned at the respective locking holes 11 and their beveled surfaces 425 engaged with the tapered ends 22 of the locking arms 21 as shown in FIG. 4, when the pair of locking arms 21 of the U-shaped shackle member 20 insert deeper into the locking holes 11, the tapered ends 22 thereof, just engaged with the beveled surfaces 425 of the sliding members 42, will force the sliding members 42 moving inwardly until the cylinder body of the arms 21 are passed through to have the latch means 424 of the sliding members 42 aligned with the beveled notches 23 of the arms 21 so that the sliding members 42 are permitted to move backward so as to have their latch means 424 engaged within the beveled notches 23 of the arms 21 and therefore the padlock is automatically locked up without use of a key. Note that the disk member 41 remains stationary during the above locking up process (as shown in FIG. 5). When unlocking, insert the key 50 into the core 30 and rotate clockwise so that the disk member 41 actuated by the core 30 rotates synchronously with the core 30 and tugs at the lever members 43 which actuate the sliding members 42 moving inwardly until the latch means 424 leave the beveled notches 23 (as shown in FIG. 6). Thus the locking arms 21 are set free to draw out of the cylinder body 10 and the padlock is unlocked. When the key 50 rotates back to original position, the sliding members 42 are urged apart by the resilient force of the compression springs 44 to their normal positions as shown in FIG. 4. Note that the rotation span of the disk member 41 is restricted by the knot means 34 in the indentation 413 of the disk member 41. This arrangement is to prevent the disk member 41 from over rotating which may mar the resilient stress of the springs 44.

Based on the aforediscussed embodiment, the padlock of the present invention provides a symmetrical arrangement of it's locking mechanism which ensures the stability as well as the durability of the lock.

Note that the specification relating to the above embodiment should be construed as to be exemplary rather than as limitative of the present invention, with many variations and modifications being readily attainable by a person of average skill in the art without departing from the spirit or scope thereof as defined by the appended claims and their legal equivalents.

I claim:

1. A locking apparatus comprising:

a hollow cylinder body having two end portions and a pair of locking holes one at each end portion, a pair of cap means fixedly closing two end portions thereof and a protrudent hole at a central portion perpendicular to said locking holes;

a U-shaped shackle member having a pair of parallel locking arms extended to identical length and each comprising a tapered end and a plurality of beveled notches formed spaced apart along an inward surface thereof;

a core secured to said protrudent hole of said hollow cylinder body, said core comprising a cylinder body having a circumferential knot on one end, a slot on an other end, a pair of recesses on lateral peripheries thereof and an axis rotatably disposed through a center, said axis having a rectangular projection on one end, a slot on an other end aligned with the slot of said cylinder body which further has a circular slot on other end with a plurality of ogives therein;

a locking mechanism disposed into said protrudent hole and secured by means of a rivet, said locking mechanism comprising:

a disk member having a central rectangular slot fitted to the rectangular projection of said core, a pair of rivets adjacent two ends of the rectangular slot respectively, and an indentation on a circumference closer to one of said rivets for receiving the knot means of said core therein;

a pair of sliding members having a cylinder body diametrically identical to an inner diameter of said hollow cylinder body, a vertical slot adjacent a cavity on an inward end, a latch means which has a beveled surface on a top and a right angular surface on a bottom thereof at other end and a transverse eye on a lateral periphery in communication with said vertical slot thereof;

a pair of compression springs disposed on one ends to the cavity of said sliding members and other ends engaged with the lateral recesses of said core;

a pair of lever members each having an eye at proximity of an outward end which inserts into the vertical slot of said sliding member and is pivotally secured by means of a rivet and an elongate slot on inward end which is movably retained by a rivet of said disk member, said lever means being reversibly arranged on said disk member and said sliding members;

whereby, said sliding members normally positioned at the locking holes of said hollow cylinder body facilitate an automatic locking up of said padlock and is centralized when rotates said disk member by means of a key.

* * * * *